US008960073B2

(12) United States Patent
Pai et al.

(10) Patent No.: US 8,960,073 B2
(45) Date of Patent: Feb. 24, 2015

(54) CYLINDER HEAD FOR A COMPRESSOR

(75) Inventors: Ramesh Pai, Charleston, SC (US); Michael Klatt, Wadmalaw Island, SC (US); Folkhard Holzel, Banteln (DE)

(73) Assignees: WABCO Europe BVBA, Brussels (BE); WABCO Compressor Manufacturing Co., Charleston, SC (US)

( * ) Notice: Subject to any disclaimer, the term of this patent is extended or adjusted under 35 U.S.C. 154(b) by 779 days.

(21) Appl. No.: 13/272,640

(22) Filed: Oct. 13, 2011

(65) Prior Publication Data

US 2013/0092019 A1 Apr. 18, 2013

(51) Int. Cl.

| | |
|---|---|
| ***F01B 31/28*** | (2006.01) |
| ***F04B 39/12*** | (2006.01) |
| ***F04B 49/035*** | (2006.01) |
| ***F04B 49/24*** | (2006.01) |

(52) U.S. Cl.

CPC ..... *F04B 39/125* (2013.01); *F04B 39/123* (2013.01); *F04B 49/035* (2013.01); *F04B 49/246* (2013.01)

USPC ..... 92/164; 29/888.02

(58) Field of Classification Search

USPC ..... 92/164; 29/888.02; 137/494; 417/307

See application file for complete search history.

(56) References Cited

U.S. PATENT DOCUMENTS

| | | | | | |
|---|---|---|---|---|---|
| 1,878,326 | A * | 9/1932 | Ricardo | ..... | 417/307 |
| 2,290,858 | A * | 7/1942 | Brown | ..... | 137/494 |
| 4,553,907 | A * | 11/1985 | Heger et al. | ..... | 417/307 |
| 4,685,653 | A * | 8/1987 | Kaltenthaler et al. | ..... | 417/307 |

* cited by examiner

*Primary Examiner* — Michael Leslie

(74) *Attorney, Agent, or Firm* — Kramer Levin Nafialis & Frankel LLP

(57) ABSTRACT

A cylinder head for a compressor includes a closure device that can be adjusted between an unactuated position (off-load) in which the compressor delivers air and an actuated position (off-load) in which the compressor is running in an idle mode, a pneumatic control device having a control cylinder and a control piston that can be moved in the control cylinder, a spring device that prestresses the closure device into the unactuated position (on-load), and a driver configured to couple the control piston to the closure device. The closure device closes a compressed air passage in the unactuated position (on-load) and clears the compressed air passage in the actuated position (off-load), and the driver is permanently connected to the closure device and can be driven by the control piston.

28 Claims, 4 Drawing Sheets

CYLINDER HEAD FOR A COMPRESSOR

FIELD OF THE INVENTION

The invention generally relates to a cylinder head for a compressor, such as of the type used in a utility vehicle.

BACKGROUND OF THE INVENTION

Compressors for utility vehicles are generally mounted directly on the motor shaft and driven by the motor. Such compressors deliver compressed air for vehicle-internal compressed air systems, for example, for pneumatic brakes, ride level control systems and other systems.

A compressor of the general type under consideration is embodied as a reciprocating piston compressor (reciprocating compressor), and has a compressor casing and a cylinder head that closes the upper side of the compressor casing. A cylinder head gasket is provided between the cylinder head and a cylinder casing. One or more cylinders with pistons that are driven by the motor shaft are formed in the cylinder casing.

The compressor is pumping during delivery phases (on-load), while during rest phases and regeneration phases the compressor generally does not deliver any air (off-load). In many utility vehicles, the compressor is rigidly arranged on the motor shaft with the result that at least one piston continues to be moved up and down in the cylinder (reciprocating movement) even during the rest phases and regeneration phases. In order to keep the energy absorption of the piston compressor low, an idling circuit is generally set in which air is merely fed to and fro without being appreciably compressed. Generally, for this purpose, for compressors with only one cylinder, the cylinder space, the volume of which is reduced in the delivery phase, is connected via an air passage to an intake space arranged upstream or a connection space. For compressors with two or more cylinders with movements in opposite directions, cylinder spaces can be connected to one another via an air passage.

In order to close and open the air passage, a closure device, which is embodied, for example, as a lamella (leaf), is generally provided in the cylinder head. In its unactuated position (on-load), the closure device closes the air passage, with the result that the compressor can deliver air. In its actuated position (off-load), the closure device opens the air passage, with the result that the compressor runs in the idling mode.

The closure device is in turn moved between its actuated position (off-load) and unactuated position (on-load) by a pneumatic control device. For this purpose, the control device receives a pneumatic input signal, generally from a governor. The pneumatic control device generally has a control cylinder that runs in the cylinder head, for example, in a transverse direction, and in which a control piston, on which compressed air coming from the governor acts, is adjustably guided. The cylinder head also includes a spring device. While the spring device is in an unactuated position (on-load), the piston is in a position of rest and the closure device is closed. When compressed air is applied by the governor, the control piston is actuated (off-load) in order to open the closure device.

The connection between the control piston and the closure device is generally brought about by a driver, which is attached in the piston and extends through a slot in the cylinder head into the cylinder space. The driver is loosely inserted into a suitable opening in the closure device, with the result that it drives the closure device during the to and fro movement of the piston.

During assembly, the control piston is inserted, generally together with the spring device, into the control cylinder. The driver is pressed or screwed into the piston through the slot, with the result that it projects downwardly to the lower side through the slot. The closure device can then be hooked by its hole into the driver from the underside of the cylinder head.

Such an assembly, however, does not provide for easy disassembly. This is because the driver, which is permanently connected to the control piston, prevents the control piston from being pulled out of the control cylinder. Thus, removal of the driver from the control cylinder often requires destroying the control piston.

Furthermore, although reliable operation and reliable actuation of the closure device is generally possible, the return of the closure device to its unactuated position (on-load) for the loading of the compressor by the spring device can be problematic. According to Hooke's Law, the force applied by the spring device increases continuously when it is moved by the piston. During the return, the force applied by the spring device in turn decreases linearly, with the result that it becomes ever smaller at the end of the movement during which the closure device is intended to completely close the compressed air passage. In this context, although the spring device can be somewhat prestressed in its unactuated position (on-load), with the result that the spring device still has a residual force for closing the closure device at the end of the movement, the force is still smallest in this part of the movement. For this purpose, compressed air assistance of the spring device can be advantageous. In such a configuration, both compressed air and the spring device act on the piston during the return of the piston. Compressed air can be fed to the piston via a gap, but there can be air leakage for such configurations.

SUMMARY OF THE INVENTION

Generally speaking, it is an object of the present invention to provide a cylinder head having a driver for coupling a control piston to a closure device, where the closure device closes a compressed air passage in an unactuated position (on-load) and clears the compressed air passage in an actuated position (off-load).

The driver can be held firmly in the closure device and can be grasped by the control piston and entrained during the to and fro movement thereof. The driver can therefore be inserted loosely, into the control piston.

According to one embodiment, the control piston has a circumferential groove in which the driver is loosely held.

According to another embodiment, the driver is positively locked in the closure device. In some embodiments, the driver can be a rivet or rivet pin.

According to yet another embodiment, the driver can be disconnected from the control piston by pulling out in a removal direction, where the removal direction is different from the movement direction of the control piston.

According to a further embodiment, the closure device is pivotably coupled to a joint, where the closure device can be released from the joint in the removal direction.

According to another embodiment of the present invention, a pocket pivotably holds the closure device. The pocket can be formed on the underside of the cylinder head, and can define the pivoting travel of the closure device. The pneumatic control device can be provided above the pocket in the cylinder head. In this context, the cylinder head can be a bearing face for bearing against a cylinder casing, where the bearing face surrounds the pocket.

According to a further embodiment, a wall region of the cylinder head is formed between the pocket and the control cylinder, where a gap through which the driver projects is formed in the wall region, and where the driver can be moved in the gap during the movement of the control piston.

According to yet another embodiment, the control piston has a piston face and an opposing piston face that lies opposite the piston face. In addition, the control cylinder can have a control space for applying compressed air to the piston face of the control piston in order to actuate the control piston, and a piston space for applying compressed air to the opposing piston face. The control space can have a compressed air connection for feeding in compressed air in order to apply compressed air to the piston face, and for outputting compressed air in order to reset the control piston into the unactuated position (on-load). In addition, when the compressed air is applied, the opposing piston face can assist the spring device in moving the control piston into the unactuated position (on-load), thereby moving the closure device to a closed state. Furthermore, in at least an end part of the closing movement of the closure device, the opposing piston face can be connected to the gap such that compressed air can be applied to the opposing piston face.

According to another embodiment, the gap can have an enlarged width in certain regions in order to enlarge the passage area for compressed air in the final part of the closing movement of the closure device.

According to a still further embodiment, a free space can be formed in the closure device, where the free space can bear against the gap in the final part of the closing movement in order to permit compressed air to pass through. As a result, the operation of the compressor can be improved. The gap through which the driver projects can be embodied according to the invention in a selective fashion such that the air through-flow is increased in order to improve the resetting of the control piston during its final movement. For this purpose, the gap can be widened in certain regions. The driver therefore does not close the gap entirely at the end of its reset. Furthermore, the feeding in of compressed air for assisting the closing movement is improved.

Also, the free space can bear, in the final part of the movement of the closure device, against the gap, with the result that a significant increase in the passage of air, and therefore assistance of the spring device, is selectively brought about. Moreover, when the closure device is in other positions, the free space does not present problems because it does not bear against the gap nor is it aligned with the gap.

In accordance with exemplary embodiments of the invention, the cylinder head can be manufactured by inserting the control piston into the control cylinder to form the pneumatic control device, providing the closure device to which the driver is permanently attached, and inserting the closure device into a pocket in the cylinder head in the mounting direction, whereby the driver is guided through a gap between the pocket and the control cylinder and is engaged in a removable fashion in the control piston, and when the closure device is inserted in the mounting direction, an articulated holder for the closure device is formed in the pocket. Disassembly can be accomplished by reversing the order of these steps.

It will be appreciated that the inventive embodiments provide a number of advantages. For example, the driver can be easily connected to the control piston, and can also be easily removed from the control piston. Accordingly, system assembly is improved. Furthermore, disassembly is possible with a small amount of expenditure without destroying the control piston.

Still other objects and advantages of the present invention will in part be obvious and will in part be apparent from the specification.

The present invention accordingly comprises the features of construction, combination of elements, and arrangement of parts as well as the various steps and the relation of one or more of such steps with respect to each of the others, all as exemplified in the following disclosure, and the scope of the invention will be indicated in the claims.

BRIEF DESCRIPTION OF THE DRAWINGS

For a fuller understanding of the invention, reference is had to the following description taken in connection with the accompanying drawings in which.

DETAILED DESCRIPTION OF THE PREFERRED EMBODIMENTS

Figure 1:
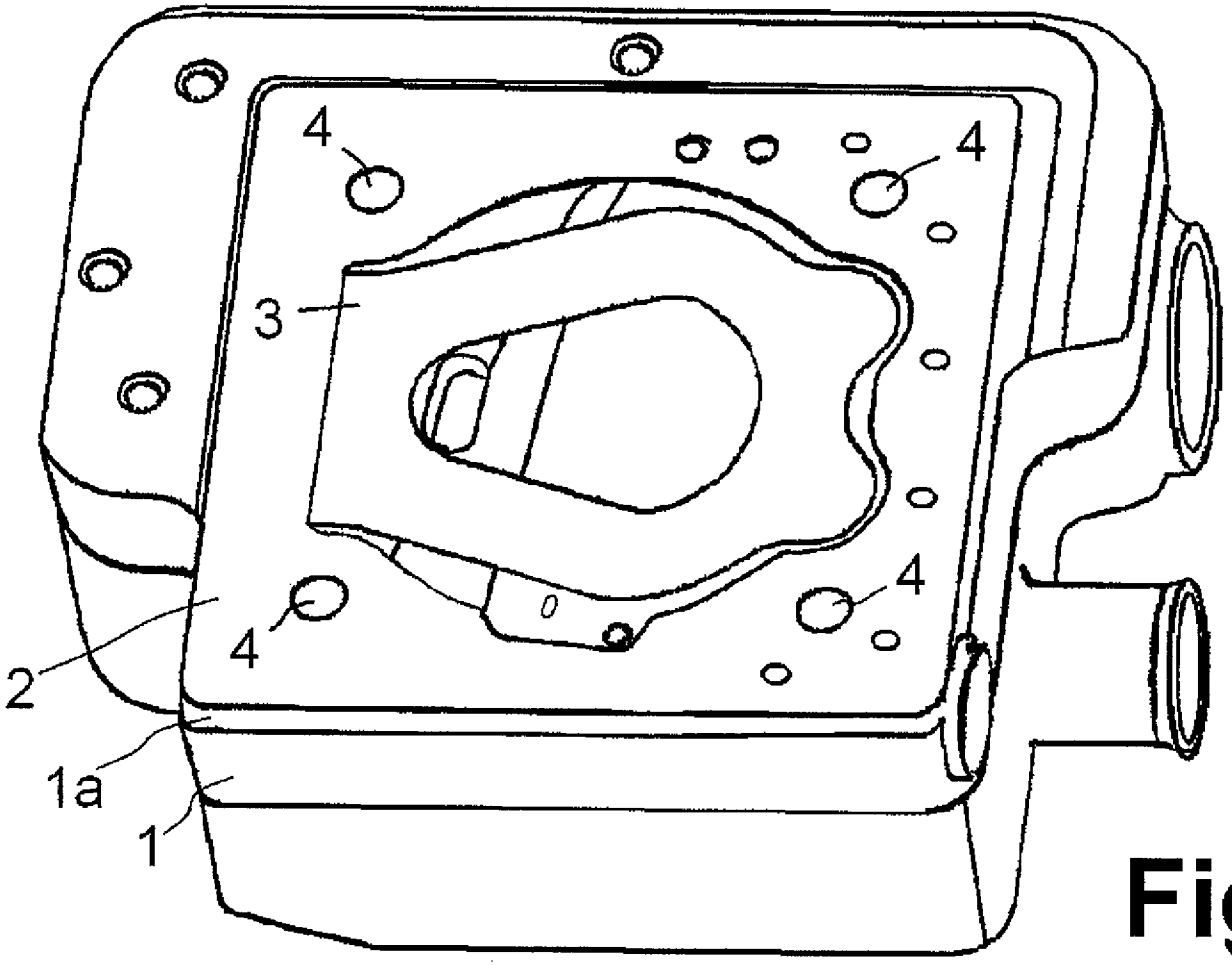
FIG. 1 shows a cylinder head with gaskets for connecting to a cylinder casing in accordance with an embodiment of the present invention.

Referring now to the drawing figures, FIG. 1 shows a cylinder head 1 in a perspective view from below. A cylinder head gasket 2 and an intake valve gasket 3 are fitted onto an underside 1*a* of cylinder head 1, and are centered, and positioned, for example, by means of centering pins 4, which protrude from underside 1*a* of cylinder head 1. A cylinder casing (not shown in FIG. 1) is fitted onto underside 1*a* of cylinder head 1. An entire compressor can therefore be formed by the cylinder casing and cylinder head 1, which is fitted on the cylinder casing. One or more cylinders with pistons for compressing air are formed in the cylinder casing. The entire compressor can be connected, for example directly, to the engine shaft of an internal combustion engine of the vehicle. Alternatively, the entire compressor can be in engagement with the internal combustion engine, and therefore be continuously driven when the engine is running.

Figure 2:
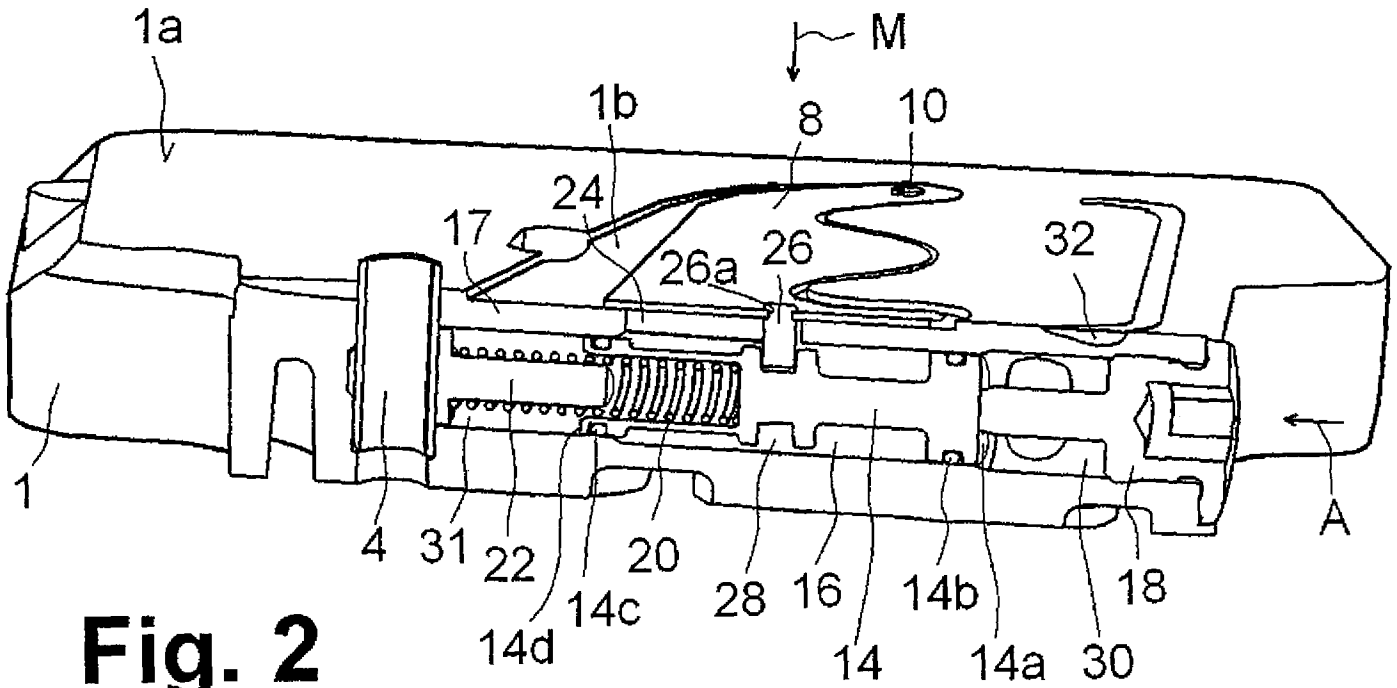
FIG. 2 is a perspective, sectional view of the cylinder head of FIG. 1.

FIG. 2 shows a more detailed, sectional view of the configuration underneath gaskets 2 and 3 (FIG. 1). A pocket 1*b* is provided in cylinder head 1, in which a closure device 8 can be accommodated such that it can pivot about a joint pin 10 that extends into pocket 1*b*. As shown in FIG. 2, a lamella can serve as closure device 8. Persons skilled in the art will appreciate that the closure device need not be limited to a lamella and other suitable structures can serve as closure device 8.

Pocket 1*b* can be formed on underside 1*a* of cylinder head 1. Cylinder head 1 can be a bearing face for bearing against a cylinder casing, where the bearing face surrounds pocket 1*b*. That is, the portion of under side 1*a* exclusive of pocket 1*b* can be considered the bearing face. Joint pin 10 can be aligned, for example, in a flush fashion, with underside 1*a*. Pocket 1*b* therefore defines the pivoting travel of the pivotable closure device 8. FIG. 2 shows the position of rest in which closure device 8 is in its unactuated (e.g., closed) position (on-load), which constitutes its right-hand position in this view.

Figure 3:
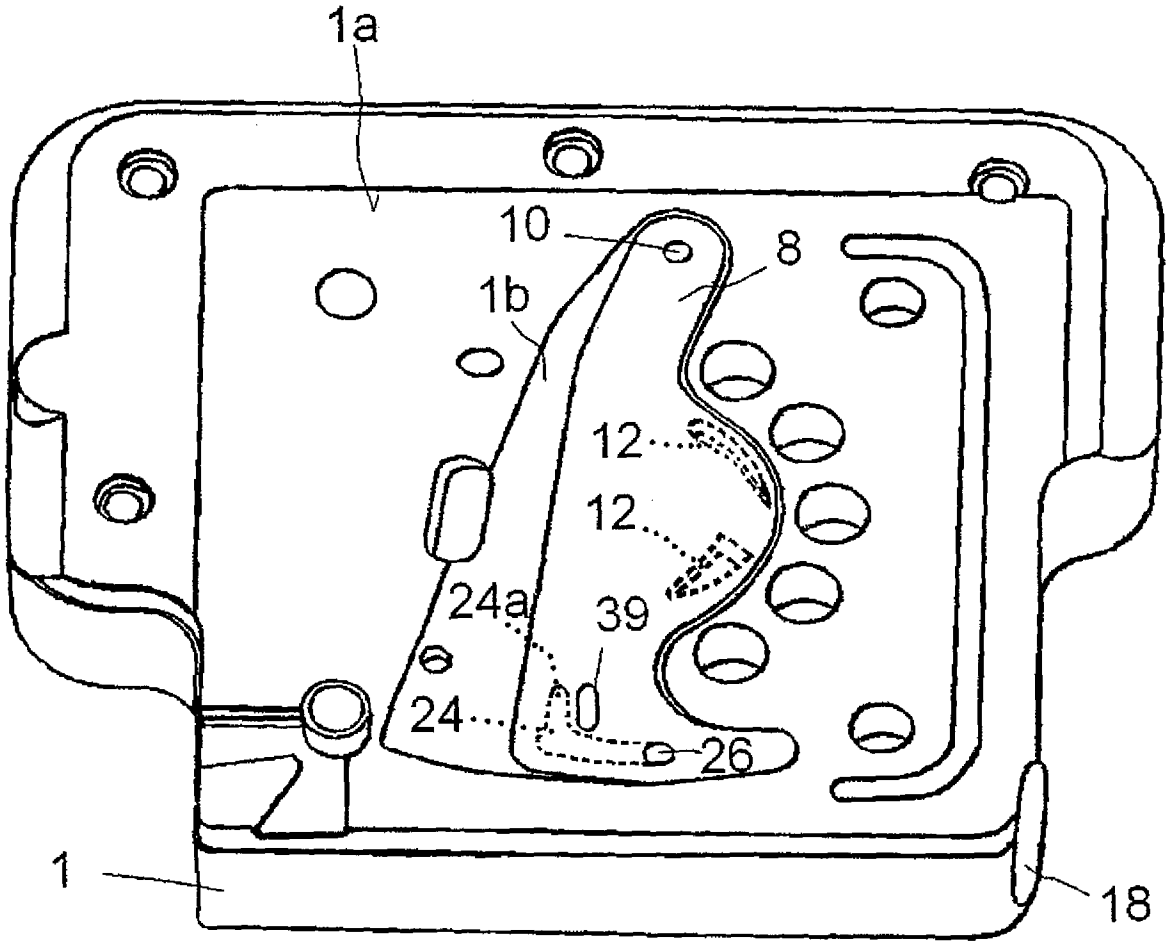
FIG. 3 shows a cylinder head without gaskets in accordance with an embodiment of the present invention.

FIG. 3 shows closure device 8 in its unactuated position (on-load). In FIG. 3, a compressed air passage 12 that is concealed by closure device 8 and formed in pocket 1*b* is indicated by dashed lines. When closure device 8 is in the unactuated position (on-load), closure device 8 closes compressed air passage 12, with the result that the compressor runs in a load mode. Correspondingly, when closure device 8 is in an actuated (off-load) (e.g., idling) position, closure device 8 opens compressed air passage 12, with the result that the compressor runs in an idling mode. Persons skilled in the art will appreciate that although compressed air passage 12 is shown as having two parts in FIG. 3, passage 12 can also have one part. A free space 39 (e.g., slot) is formed in closure device 8.

When closure device 8 is pivoted towards the left from the unactuated position (on-load) into its actuated position (off-load), it opens the compressed air passage 12, with the result that air can flow from a cylinder space formed in the cylinder casing and through compressed air passage 12 in order to permit an idling operation of the compressor. The compressor therefore operates with relatively low energy consumption without delivering compressed air in an idling operation.

Referring back to FIG. 2, the adjustment from the shown unactuated position of closure device 8 (on-load) into its actuated position (off-load) is carried out by a control piston 14, which is guided in a longitudinally adjustable fashion in a control cylinder 16, where control cylinder 16 is formed underneath pocket 1*b* in cylinder head 1. Control cylinder 16 and control piston 14, which can be moved in control cylinder 16, can be jointly referred to as a "pneumatic control device".

Control piston 14 has a piston face 14*a* to which compressed air is applied in order to actuate control piston 14. For this purpose, control piston 14 rests, in the basic position or position of rest shown in FIG. 2, against a stop 18, which is screwed into control cylinder 16. Control piston 14 is sealed in the control cylinder 16 by means of two O-ring seals 14*b*, 14*c*, and acts against a helical spring 20, which is guided on a spring guide 22. Spring guide 22 is attached in the cylinder head 1. In the embodiment shown, helical spring 20 is guided into control piston 14 in order to avoid buckling.

A wall region 17 of cylinder head 1 is formed between pocket 1*b* and control cylinder 16. A gap 24, through which a connection pin 26 projects, is formed in wall region 17. As shown in FIG. 2, a connection pin can be provided as driver 26. Driver 26 can be embodied, for example, as a rivet (rivet pin) that has a circumferential channel 26*a* with which driver 26 is held in closure device 8. Driver 26 extends from pocket 1*b* through gap 24 and into control cylinder 16. Driver 26 further extends into a circumferential groove 28 of control piston 14. Circumferential groove 28 can disposed around control piston 14. Driver 26 is therefore entrained (e.g., pulled along) during the longitudinal adjustment of control piston 14, and, as a result, closure device 8 is pivoted. Driver 26 can be held firmly (e.g., in a positive locking fashion) in closure device 8. By contrast, driver 26 can rest loosely (e.g., without a clamping effect) in circumferential groove 28 of control piston 14.

Piston face 14*a* is located in a control space 30 which can be filled with compressed air and emptied through a compressed air connection 32, where compressed air connection 32 can be connected via corresponding valves. By applying compressed air via compressed air connection 32, control piston 14 can be moved to the left, counter to the effect of helical spring 20 of FIG. 11*n* the process, control piston 14 entrains driver 26, with the result that the closure device 8 is pivoted to the left into its actuated position (off-load) from the unactuated position (on-load) (shown in FIG. 2).

Figure 4:
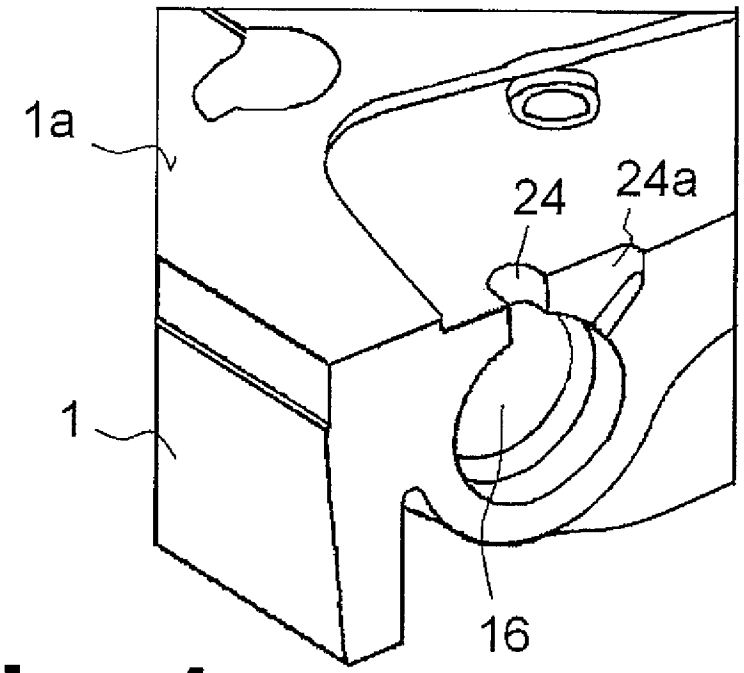
FIG. 4 is a perspective sectional view of a control cylinder in accordance with an embodiment of the present invention.

Consequently, as shown in FIG. 4, compressed air passage 12 can be opened. Referring back to FIG. 2, control cylinder 16 can also have a spring space 31 to the left of driver 26. Helical spring 20 can be guided in spring space 31. An opposing piston face 14*d* can be formed in spring space 31.

As shown in FIG. 3, free space 39, which is formed in closure device 8, is located next to a widened portion 24*a* (e.g., bend) in gap 24 while closure device 8 is in the actuated position (off-load). As a result, no air can flow through free space 39 into gap 24. The precise embodiment of widened portion 24*a* of the gap is shown in more detail in the illustration in FIG. 4.

After the application of compressed air has ended, the venting via compressed air connection 32 can take place. Helical spring 20 therefore relaxes and presses the control piston 14 back (e.g., to the right in FIG. 2). For example, helical spring 20 can press against an end of control piston 14 that lies opposite piston face 14*a*. As a result, control piston 14 outputs the air from control space 30 to compressed air connection 32. As closure device 8 is pivoting back to the right to the unactuated position (on-load), free space 39 overlaps with widened portion 24*a* of gap 24 (FIG. 4). As a result, compressed air now passes from the compressor into pocket 1*b* through free space 39, and into spring space 31 through widened portion 24*a* of gap 24. Compressor air can therefore be applied to opposing piston face 14*d*, which assists in the closing movement of control piston 14.

The unactuated position (on-load) of closure device 8 is advantageously not defined by a stop in pocket 1*b* but rather by stop 18 of control piston 14.

For the purpose of assembling the arrangement shown in FIG. 2, closure device 8 is firstly connected to driver 26, for which purpose driver 26 is embodied as a rivet with widening end regions. Persons skilled in the art will appreciate that driver 26 can also be embodied, for example, as a screw and/or a nut. Furthermore, spring guide 22 is attached to control cylinder 16, and control piston 14 and spring 22 are introduced laterally into control cylinder 16 in an axial direction shown by an arrow A. Then, control cylinder 16 can be closed by stop 18.

As shown in FIG. 2, closure device 8 together with driver 26 can be inserted from above in a mounting direction shown by an arrow M (e.g., in an installation position of the entire compressor from below), in such a way that closure device 8 is held in (e.g., pivotably coupled to) joint pin 10. Driver 26 can project into circumferential groove 28 of control piston 14.

For the purpose of disassembly, closure device 8 together with driver 26 can be pulled out, in accordance with a reverse order, from joint pin 10 and control piston 14 in a removal direction counter to the mounting direction. Stop 18 and control piston 14 together with helical spring 20 can then be removed from control cylinder 16 counter to the axial direction.

It is to be understood that the present invention is suitable for all types of gas compressor designs, whatever the principle of operation in any individual case. The invention is also suitable for all types of gases. Only as an example, the air compressor using piston construction, such as the one normally used in automotive engineering, is mentioned as a special area of application.

It will be seen that the objects set forth above, among those made apparent from the preceding description, are efficiently attained, and since certain changes may be made without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention that, as a matter of language, might be said to fall therebetween.

What is claimed is:

1. A cylinder head for a compressor, the cylinder head comprising:

a closure device adjustable between an unactuated position and an actuated position, the closure device operative to close a compressed air passage in the unactuated position and to clear the compressed air passage in the actuated position;

a pneumatic control device including a control cylinder and a control piston movable in the control cylinder;

a spring device that prestresses the closure device into the unactuated position; and a driver operative to couple the control piston to the closure device, the driver being permanently connected to the closure device and drivable by the control piston, wherein the control piston has a circumferential groove configured to hold the driver.

2. The cylinder head of claim 1, wherein the driver is positively locked in the closure device.

3. The cylinder head of claim 2, wherein the driver is at least one of a rivet and a rivet pin.

4. The cylinder head of claim 1, wherein the spring device is held in the control cylinder and presses against an end of the control piston opposite the piston face.

5. The cylinder head of claim 1, wherein the driver is disconnectable from the control piston in a removal direction different from a movement direction of the control piston.

6. The cylinder head of claim 1, further comprising:

a pocket defined on an underside of the cylinder head, the pocket being configured to pivotably hold the closure device.

7. A cylinder head for a compressor, the cylinder head comprising:

a closure device adjustable between an unactuated position and an actuated position, the closure device operative to close a compressed air passage in the unactuated position and to clear the compressed air passage in the actuated position;

a pneumatic control device including a control cylinder and a control piston movable in the control cylinder;

a spring device that prestresses the closure device into the unactuated position; and a driver operative to couple the control piston to the closure device, the driver being permanently connected to the closure device and drivable by the control piston, wherein the driver is positively locked in the closure device, and wherein the driver is at least one of a rivet and a rivet pin.

8. A cylinder head for a compressor, the cylinder head comprising:

a closure device adjustable between an unactuated position and an actuated position, the closure device operative to close a compressed air passage in the unactuated position and to clear the compressed air passage in the actuated position;

a pneumatic control device including a control cylinder and a control piston movable in the control cylinder;

a spring device that prestresses the closure device into the unactuated position; and a driver operative to couple the control piston to the closure device, the driver being permanently connected to the closure device and drivable by the control piston, wherein the driver is disconnectable from the control piston by pulling out in a removal direction different from a movement direction of the control piston.

9. The cylinder head of claim 8, wherein the closure device is pivotably coupled to a joint pin, and wherein the closure device can be released from the joint pin in the removal direction.

10. The cylinder head of claim 8, wherein the control piston has a circumferential groove configured to hold the driver.

11. The cylinder head of claim 8, wherein:

the driver is positively locked in the closure device; and the driver is at least one of a rivet and a rivet pin.

12. The cylinder head of claim 8, further comprising:

a pocket defined on an underside of the cylinder head, the pocket being configured to pivotably hold the closure device.

13. A cylinder head for a compressor, the cylinder head comprising:

a closure device adjustable between an unactuated position and an actuated position, the closure device operative to close a compressed air passage in the unactuated position and to clear the compressed air passage in the actuated position;

a pneumatic control device including a control cylinder and a control piston movable in the control cylinder;

a spring device that prestresses the closure device into the unactuated position; and a driver operative to couple the control piston to the closure device, the driver being permanently connected to the closure device and drivable by the control piston, wherein a pocket in which the closure device is pivotably held is formed on an underside of the cylinder head.

14. The cylinder head of claim 13, wherein the pocket defines the pivoting travel of the closure device.

15. The cylinder head of claim 13, wherein the pneumatic control device is provided above the pocket in the cylinder head.

16. The cylinder head of claim 13, wherein the cylinder head provides a bearing face for bearing against a cylinder casing, wherein the bearing face surrounds the pocket.

17. The cylinder head of claim 13, wherein a wall region of the cylinder head is formed between the pocket and the control cylinder, wherein a gap through which the driver projects is formed in the wall region, and wherein the driver can be moved in the gap during the movement of the control piston.

18. The cylinder head of claim 17, wherein the control piston has a piston face and an opposing piston face which lies opposite the piston face.

19. The cylinder head of claim 18, wherein the control cylinder has a control space for applying compressed air to the piston face of the control piston in order to actuate the control piston, and a spring space for applying compressed air to the opposing piston face.

20. The cylinder head of claim 19, wherein the control space has a compressed air connection for feeding in compressed air to apply compressed air to the piston face, and for outputting compressed air to reset the control piston into the unactuated position.

21. The cylinder head of claim 20 wherein the opposing piston face is operable to assist the spring device in moving the control piston into the unactuated position when the compressed air is applied.

22. The cylinder head of claim 21, wherein in at least an end part of a closing movement of the closure device, the opposing piston face is connected to the gap such that the compressed air is applied to the opposing piston face.

23. The cylinder head of claim 22, wherein the gap has at least one widened portion in order to enlarge a passage area for compressed air in a final part of the closing movement of the closure device.

24. The cylinder head of claim 23, wherein a free space is formed in the closure device, and wherein the free space bears against the gap in the final part of the closing movement in order to permit compressed air to pass through.

25. The cylinder head of claim 13, wherein the control piston has a circumferential groove configured to hold the driver.

26. The cylinder head of claim 13, wherein:

the driver is positively locked in the closure device; and the driver is at least one of a rivet and a rivet pin.

27. The cylinder head of claim 13, wherein the driver is disconnectable from the control piston in a removal direction different from a movement direction of the control piston.

28. A method for manufacturing a cylinder head of a compressor, the method comprising:

inserting a control piston into a control cylinder in order to form a pneumatic control device;

providing a closure device to which a driver is permanently attached; and inserting the closure device into a pocket in the cylinder head in a mounting direction, wherein when the closure device is inserted in the mounting direction, the driver is guided through a gap between the pocket and the control cylinder and engages in a removable fashion in the control piston, and when the closure device is inserted in the mounting direction, an articulated holder for the closure device is formed in the pocket.

* * * * *